United States Patent [19]

Lopes

[11] Patent Number: 4,688,550

[45] Date of Patent: Aug. 25, 1987

[54] MEANS AND PREPARATION PROCESS, FOR BURNING, OF AN EMULSION CONTAINING WATER AND HEAVY OIL

[75] Inventor: Homero V. D. M. Lopes, Sao Paulo, Brazil

[73] Assignee: Homero Lopes & Associados/Engenharia e Comercio Ltda., Sao Paulo, Brazil

[21] Appl. No.: 747,931

[22] Filed: Jun. 20, 1985

[51] Int. Cl.[4] ..... A47J 27/06

[52] U.S. Cl. ..... 126/378; 431/4; 165/169; 369/149

[58] Field of Search ..... 366/149; 431/4, 208; 165/169; 126/377, 378

[56] References Cited

U.S. PATENT DOCUMENTS

| | | | |
|---|---|---|---|
| 1,351,352 | 8/1920 | Stevens | 366/149 |
| 1,586,987 | 6/1926 | Govers | 126/378 |
| 1,810,637 | 6/1931 | Beers | 126/377 |
| 2,555,682 | 6/1951 | Daun | 165/169 |
| 4,144,015 | 3/1979 | Berthiaume | 431/4 |
| 4,352,572 | 10/1982 | Chen | 431/4 |
| 4,416,610 | 11/1983 | Gallagher | 431/4 |

FOREIGN PATENT DOCUMENTS

WO80/02589 11/1980 PCT Int'l Appl. .

*Primary Examiner*—Carroll B. Dority, Jr.
*Attorney, Agent, or Firm*—Michael J. Striker

[57] ABSTRACT

An emulsion preparation arrangement includes an emulsion preparation tank, a jacket which surrounds the tank on its sides and bottom and contains hot water, a plurality of tubes for supplying components of the emulsion and withdrawing the emulsion, and a plurality of ducts each surrounding a respective one of the tubes and containing hot water for heating the ducts with the water in the jacket and the ducts at a temperature of 80° C., to enable the emulsion to be discharged at a temperature of approximately 50° C.

10 Claims, 3 Drawing Figures

MEANS AND PREPARATION PROCESS, FOR BURNING, OF AN EMULSION CONTAINING WATER AND HEAVY OIL

BACKGROUND OF THE INVENTION

The present refers to the improvements of new constructive dispositions introduced in the means of preparation of the emulsion and in the process of its preparation for burning in an atomizer nozzle, in order to obtain effectively the advantages foreseen in previous solutions and obtain other consequences which complete and enlarge the efficiency of the final result.

In this manner, as it is known, in a previous solution, heavy oil and water were mixed synthetically in equal parts in an adequate mixer where an homogenized emulsion was obtained by the adhesion of the particles of oil and water, such as emulsion under these conditions was taken by pumping to a distribution tank where it was maintained at the same temperature, following the emulsion, by pumping, with its own pressure and at an approximate temperature of one hundred and ten degrees Centigrade, until its injection into the combustion chamber, at which moment while burning by an atomizer nozzle, chemical reactions determine an accentuated increase in calories.

In performing the practical experiments of that solution, it was found that for the effective intended advantages foreseen plus the effective final reduction in the consumption of heavy oil to the order of 15% (fifteen percent), for a reduction of 80% (eighty percent) of the carbon particles in the combustion gases, for the reduction of sulphur dioxide, to the order of one micro-gram per cubic meter of gas at normal temperature when the accepted limit by the official entities is to the order of two hundred and sixty five micro-grams, aside from the appreciable reduction of nitrogen oxide to a level of twenty p.p.m., against two hundred and twenty five p.p.m. found in the burning of heavy oil, it would be necessary to introduce improvements, with which all of these objectives become effectively reached, in an effective and definite manner.

SUMMARY OF THE INVENTION

For the attainment of these objectives, aside from the improvements specifically introduced in the preparation process and the emulsion maintenance for the ideal burning conditions, in the first place the emulsion preparation tank was given a peculiar heating device, consisting of a surrounding external jacket on the whole tank, containing in its interior heated water, so that the emulsion being prepared is being heated and maintenance of the temperature itself, at the desired specific indexes, would be maintained precise and uniform.

On the other hand, due to the need of maintaining ideal the heat indexes of the emulsion, from its preparation to its spraying by the atomizer in the interior of the combustion chamber, it is introduced by the present, heating through hot water of all of the equipment tubing, from the water and oil supply tanks of the equipment, passing through the preparation tank of the emulsion up to the final sector containing the atomizer nozzle, this heating is made by spiralled ducts involving the tubing or by this tubing being involved lengthwise by coaxial external ducts, in such a way that the spiralled ducts or the lengthwise external ducts are lined externally by isolating material plates or troughs.

In this manner, to better understand how the current invention is constituted and specifically on the part of the improvements introduced in the constructive means of its preparation, illustrative drawings are presented attached, in a non-restrictive character. DR

DESCRIPTION OF PREFERRED EMBODIMENTS

Figure 1:
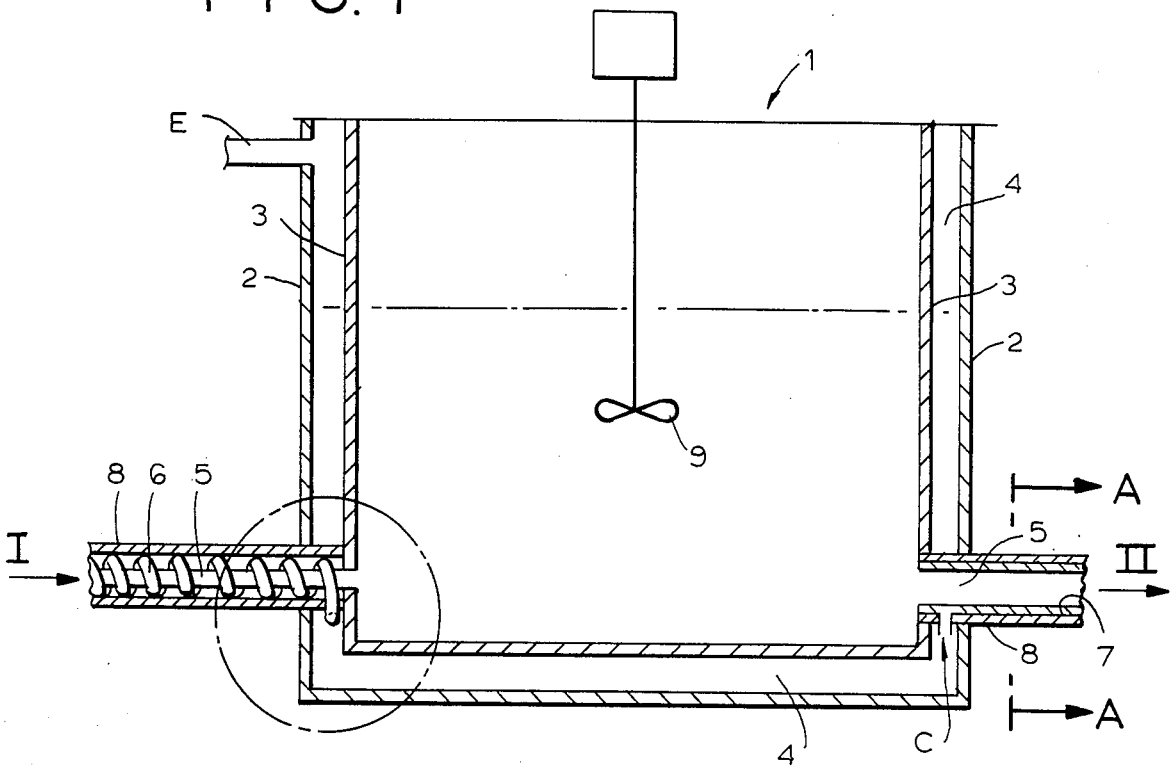
FIG. 1: shows, schematically and in elevation, the oil and water mixture tank and where the emulsion is formed, where the heated water jacket can be seen which surrounds the tank.
Figure 2:
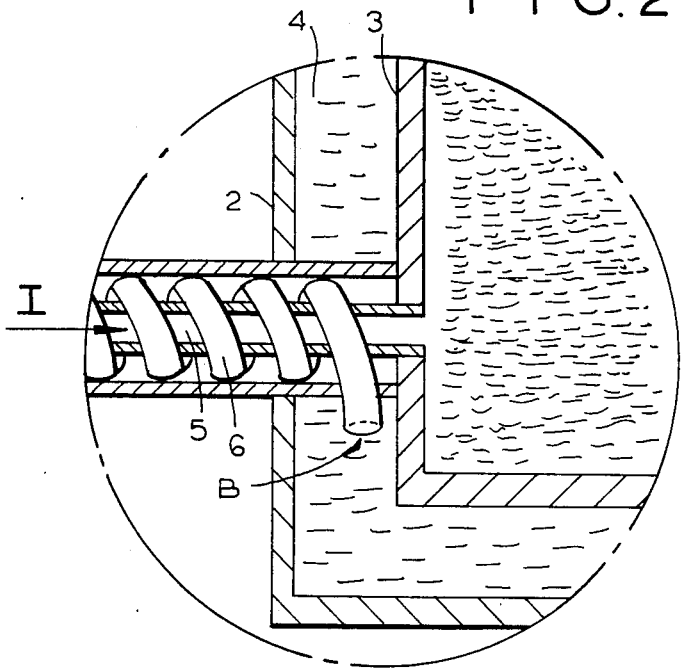
FIG. 2: shows the detail in a circle indicated in the previous figure, where the heated water jacket sector and the inlet tubing to the tank can be seen, surrounded by the hot water heating spiral duct.
Figure 3:
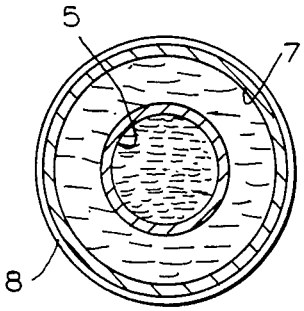
FIG. 3: reveals the A—A section of the first figure, by which one can verify the heating medium of the piping, constituted by the external coaxial tube containing internally heated water.

A preparation tank (1) of the emulsion is surrounded on the sides and below by a jacket (2) which externally to the tank wall (3) contains heated water (4) supplied through an inlet pipe E. A tube (5) for supplying, the components (water and heavy oil) of the emulsion in direction I and a tube (5) for withdrawing the emulsion in direction II until it is atomized through the nozzle inside the combustion chamber are surrounded externally by spiral ducts (6) or coaxial ducts (7) respectively. The ducts (6) or (7) contain internally, heated water supplied from the jacket (2). Through the opening B in the duct (6) the hot water from the jacket (2) flows into the pipe (6). Through the opening C in the duct (7) the hot water from the jacket flows into the duct (7). The ducts (6) and (7) are surrounded externally by heat insulation (8). On the part related specifically to the preparation process, emulsion conduction and burning, the current improvements include the fact that, for emulsion preparation, the weight of the oil is equal to 55% of the weight of the emulsion, allowing for a variation, of more or less, 10% approximately, the blade rotation (9) speed of the mixer, to form the emulsion, must be set at 700 r.p.m., allowing for a variation of approximately 10%.

The hot water for heating the tank mixture, through the jacket (2) and for heating the tubes through the ducts (6) or (7) must be set at 80° C. (eighty degrees Centigrade), allowing for a variation of 10%, for more or less, and the emulsion, in the mixer, will be in conditions to be conducted to the distribution tank, when its temperature is at 50° C. (fifty degrees Centigrade), allowing for a variation of 10% for more or less, as soon as the emulsion is at these temperature conditions leaving the distribution tank it shall be pressurized to 10 $kg/cm^2$, at the minimum. Finally, after being heated by electrical resistances, the pressurized emulsion shall have its temperature raised to 135° C., allowing for a variation of 10% for more or less, before it is atomized in the combustion chamber, when it will then be at a minimum pressure of 15 $kg/cm^2$. The emulsion, after its preparation, is led to the temperature conditions already foreseen for the distribution tank and in the same it will rest for a period, necessary for the total elimination of air contained in the interstices of the emulsioned bubbles, this period varies proportionally to the height of the stored emulsion.

I claim:

1. An arrangement for preparation of water-heavy oil containing emulsions, comprising a tank having a side wall and a bottom; means forming a jacket around said side wall and said bottom of said tank to accommodate hot water for heating said walls and said bottom of said tank; at least one inlet tube for supplying water and heavy oil components of an emulsion into said tank; at least one outlet tube for withdrawing a prepared emulsion; means forming at least two ducts each surrounding and extending lengthwise of a respective one of said tubes and including means accommodating hot water from said jacket to said ducts to heat said tubes, so that the hot water in said jacket allows preparation of the emulsion and the hot water in said ducts allows supply of the emulsion components into said tank and withdrawal of the emulsion from said tank; and a heat insulating material surrounding said ducts.

2. An emulsion preparation tank as defined in claim 1, wherein at least one of said ducts is spiral shaped and extends spirally around a respective one of said tubes.

3. An emulsion preparation tank as defined in claim 1, wherein at least one of said tubes has a longitudinal axis, at least one of said ducts being arranged around and coaxially said one tube.

4. An emulsion preparation tank as defined in claim 1; and further comprising means for mixing the components of the emulsion in said tank so as to form the emulsion and including at least one rotatable plate.

5. A method of preparation of a water-heavy oil containing emulsion, comprising the steps of providing an emulsion preparation tank having a side wall and a bottom, at least one supply tube for supplying water and heavy oil components into the tank, and at least one withdrawing tube for withdrawing the prepared emulsion; heating the side wall and the bottom of the tank by hot water accommodated in a jacket surrounding the side wall and the bottom of the tank; heating the tubes by hot water accommodated in ducts which surround and extend along the tubes; and heat insulating the ducts by a heat insulating material surrounding the ducts.

6. A method as defined in claim 5, wherein said heating steps includes heating the side walls and the bottom and also the tubes by the hot water at a temperature of approximately 80° C. with a variation of approximately 10%, so as to allow withdrawal of the emulsion from the tank at a temperature of approximately 50° C. with a variation of approximately 10%.

7. A method as defined in claim 5, wherein said emulsion contains approximately 55% of heavy oil with a variation of 10%; and further comprising the step of mixing the emulsion in the tank by a rotatable blade with a speed of 700 revolutions per minute with a variation of approximately 10%.

8. A method as defined in claim 5; and further comprising the step of transporting the emulsion from the preparation tank to a distribution tank; withdrawing the emulsion from the distribution tank and pressurizing the emulsion minimum to approximately 10 $kg/cm^2$; raising the temperature of the emulsion to approximately 135° C. with a variation of approximately 10%; and atomizing the emulsion at a minimum pressure of approximately 15 $kg/cm^2$.

9. A method as defined in claim 8; and further comprising the step of resting the emulsion in the distribution tank for a period sufficient for total elimination of air contained in intertices of emulsioned bubbles of the emulsion, in correspondence with the height of the emulsion in the distribution tank.

10. A method as defined in claim 5; and further comprising the step of communicating the ducts with said jacket so that the hot water from the jacket is supplied into the ducts.

* * * * *